United States Patent [19]

Romanski

[11] 4,300,982

[45] Nov. 17, 1981

[54] WET PRESS FELT

[75] Inventor: Eric R. Romanski, Delmar, N.Y.

[73] Assignee: Albany International Corp., Menands, N.Y.

[21] Appl. No.: 646,328

[22] Filed: Jan. 2, 1976

[51] Int. Cl.[3] ..... D21F 3/02

[52] U.S. Cl. ..... 162/358; 162/205

[58] Field of Search ..... 428/195, 196, 141, 143, 428/147, 195, 281, 320; 427/282, 288; 139/425 A; 162/116, 115, DIG. 1, 205, 289, 358, 348, 199; 100/118

[56] References Cited

U.S. PATENT DOCUMENTS

| | | | |
|---|---|---|---|
| 676,657 | 6/1901 | Macadam | 428/196 |
| 2,798,820 | 7/1957 | Nelson | 428/196 |
| 2,936,328 | 5/1960 | Sillcox et al. | 428/195 |
| 2,984,342 | 5/1961 | Smith | 428/14 |
| 3,034,180 | 5/1962 | Greiner et al. | 162/DIG. 1 |
| 3,214,327 | 10/1965 | Wicker et al. | 162/358 |
| 3,262,840 | 7/1966 | Hervey | 162/358 |
| 3,301,740 | 1/1967 | Stiehl et al. | 428/195 |
| 3,399,111 | 8/1968 | Beaumont et al. | 162/358 |
| 3,549,742 | 12/1970 | Benz | 162/DIG. 1 |
| 3,613,258 | 10/1971 | Jamieson | 162/358 |

*Primary Examiner*—Stanley S. Silverman

*Attorney, Agent, or Firm*—Kane, Dalsimer, Kane, Sullivan and Kurucz

[57] ABSTRACT

A papermakers press felt having a raised pattern of substantially incompressible islands which provide void area on the back of the felt for the free passage of water which has been squeezed from the felt by press rolls, allowing lateral as well as longitudinal flow and providing a degree of pumping action.

4 Claims, 5 Drawing Figures

10
A

WET PRESS FELT

BACKGROUND OF THE INVENTION

In the papermaking process water is frequently effectively removed from the paper sheet by press removal as the sheet and felt upon which it is being transported are squeezed between rolls in the press section. In this procedure the water has been moved out of the felt through the felt and in some designs through holes in rolls of the press nip or through grooves formed in the rolls. A recent technique is shown in U.S. Pat. No. 3,613,258 issued Oct. 19, 1971 wherein a plurality of monofilaments are adhered to the back side of the press fabric to provide a plurality of water conveying channels into which water expressed from a paper sheet located on the face of the fabric is directed for removal. An improvement on that technique is found in the presently pending application for United States Letters Patent Serial No. entitled "Wet Press Felt" in which a press fabric is coated and/or treated on the backside thereof and grooves formed therein to provide the generally parallel flow channels.

SUMMARY OF THE INVENTION

A press fabric for use in a papermaking machine for transporting paper sheet for pressing in the nip of press rolls comprising a fabric which is needled, woven or nonwoven or a combination thereof to provide a water permeable structure having on the backside thereof a plurality of discrete spaced raised relatively incompressible islands which provide intersecting channels which allow lateral and longitudinal flow of water expressed from a paper sheet located on the upper surface of the press fabric upon pressing in the nip.

DESCRIPTION OF THE PREFERRED EMBODIMENT

Figure 1:
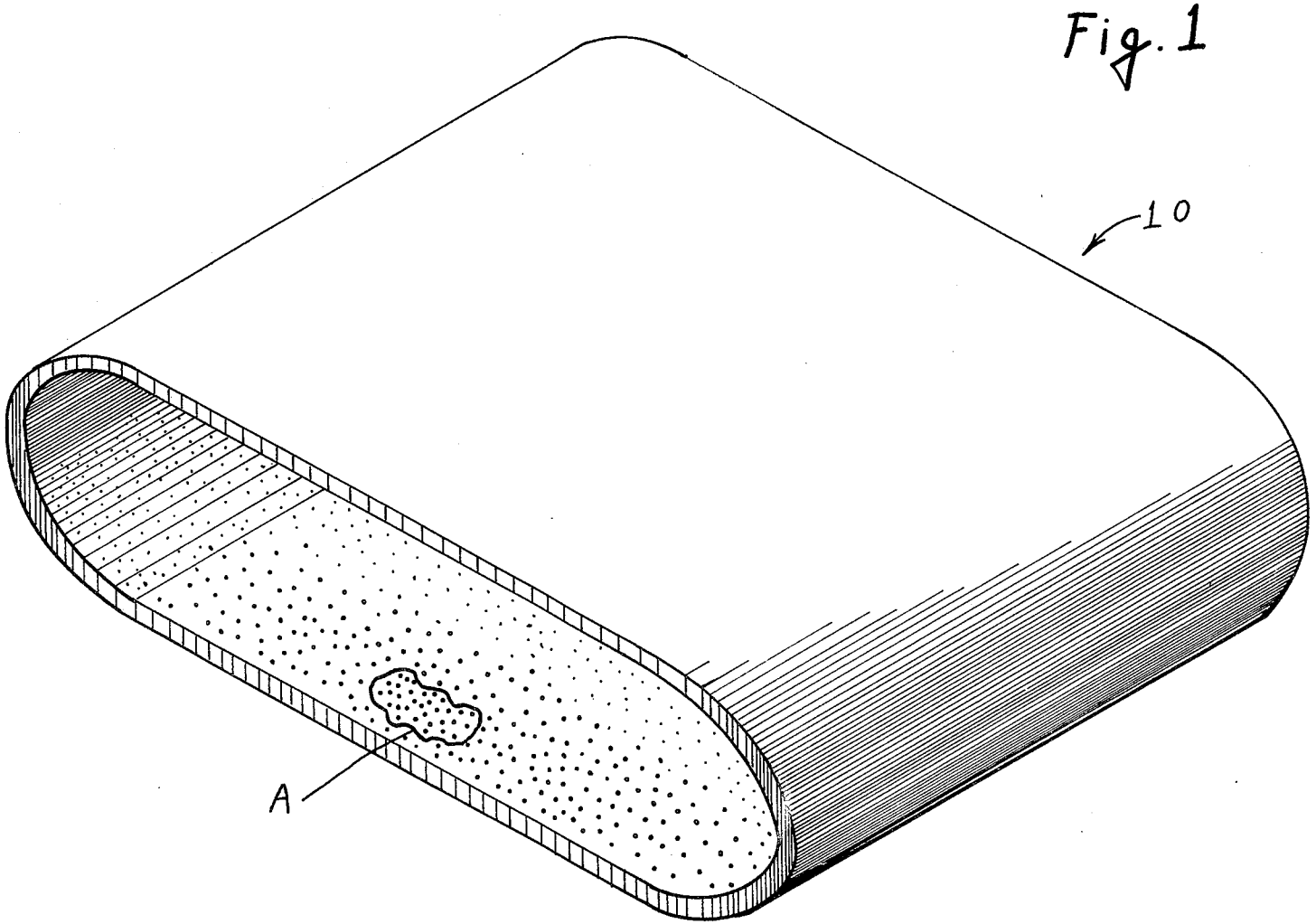
FIG. 1 is a perspective view of a papermakers felt constructed in accordance with the teachings of this invention.
Figure 2:
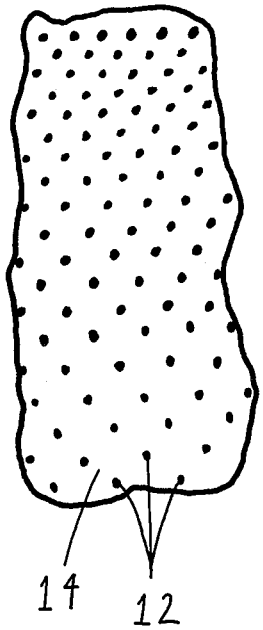
FIG. 2 is an enlarged segmentary view of the portion of the backside of the felt shown in FIG. 1 indicated by the letter A in FIG. 1 illustrating one pattern as applied thereto.

In the drawing in FIGS. 1 and 2 an embodiment of the invention is shown in which the numeral 10 designates a press fabric constructed in accordance with the present invention and the numeral 12 designates individual, discrete, relatively incompressible raised dots on the back of the felt. The spacing or area between the dots as seen in FIG. 2 is indicated generally by the numeral 14 and provides a matrix of intersecting channels for the free passage of water which has been squeezed from the felt by press rolls, allowing lateral as well as longitudinal flow and providing a degree of pumping action.

The fabric can be woven, a woven substrate with needled web or totally needled. In the embodiment herein by way of example only the fabric comprises a woven substrate and needled web. Where a woven substrate is utilized any suitable weave can be employed.

The fabric is selected in order to provide the usual desired characteristics in a press felt and the construction and materials, including the type of yarns utilized when a woven substrate is present are so selected. Thus in selecting felt construction and materials for use in this invention the usual major desirable properties of a press felt must be considered. The felt must be selected insofar as it is possible to provide uniform pressure distribution in the nip, low fluid flow resistance in the nip and minimum rewetting of the paper web from the felt.

Figure 4:
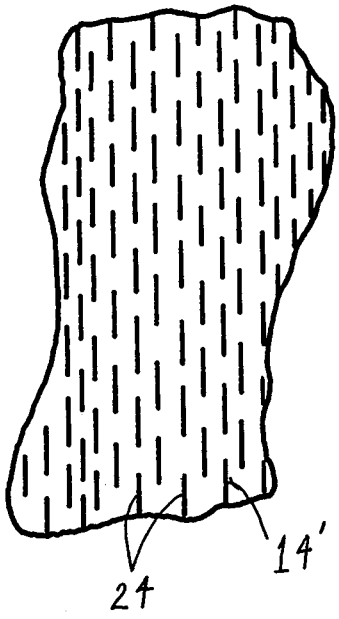
FIG. 4 is an enlarged segmentary view similar to that of FIG. 2 illustrating an alternate pattern as applied to the backside of the felt.
Figure 5:
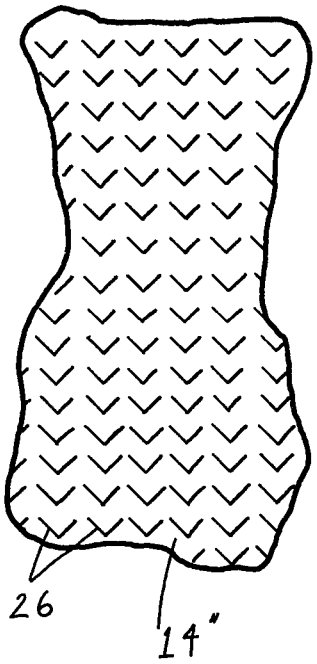
FIG. 5 is an enlarged segmentary view similar to those of FIGS. 2 and 4 illustrating still another alternate pattern as applied to the backside of the felt.

In the preferred embodiment of the invention the pattern is applied by rotary screen stencil. The stenciled pattern can be of many variations such as dots, as shown in FIG. 2, ovalesque slots as shown in FIG. 4, straight or staggered chevrons as shown in FIG. 5 or any other suitable pattern of discrete, spaced raised relatively incompressible islands which provide intersecting channels which allow lateral and longitudinal flow of water expressed from a paper sheet located on the upper surface of the press fabric upon pressing in the nip. The pattern material can be composed of a variety of materials such as PVC, urethanes, foams or latexes. The preferred material is PVC. The deposit of the material can be from 0.005" to 0.060" thick but a thickness of 0.020" is preferred. The closeness and thickness of the pattern deposit dictates the degree of bridge support and void volume on the back of the felt.

Figure 3:
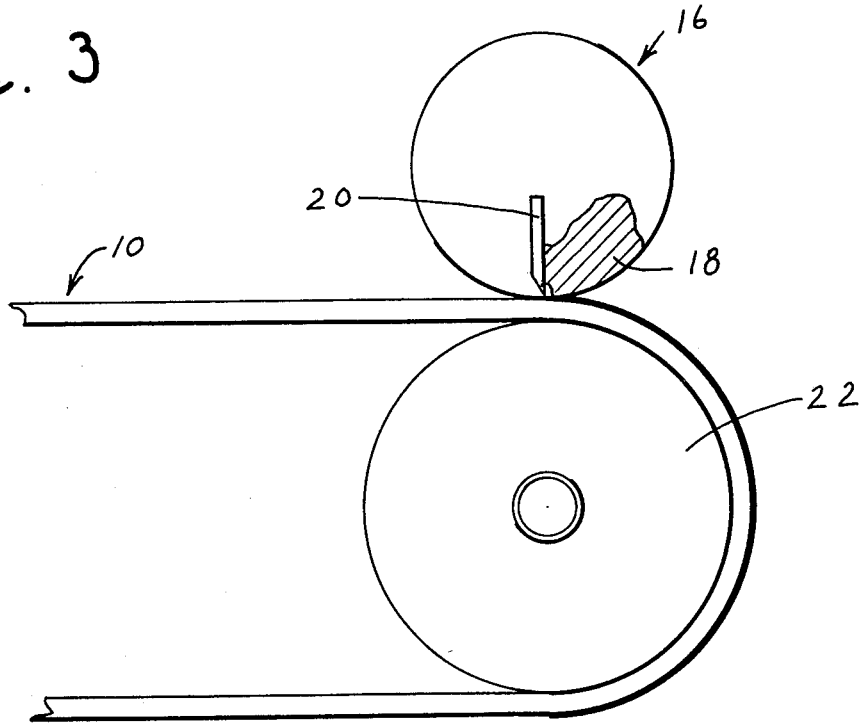
FIG. 3 is a partially diagrammatic view illustrating a preferred method of applying the pattern shown in FIG. 2 to the backside of the felt shown in FIG. 1.

The pattern is applied using a conventional rotary screen stencil as known in the industry. Referring to FIG. 3 the pattern to be deposited on the backside of felt 10 is engraved on the rotary stencil screen 16 in the conventional way. The rotary stencil screen is positioned on the surface of the felt to be printed. Inside the rotary screen is a pond of pattern material 18 such as PVC which is deposited behind wiper blade (squeegee) 20 and as the felt passes under the stencil screen the screen rotates under the influence of drive roll 22. The printing material fills the pattern voids and as the pattern void passes under the squeegee excess pattern material is wiped away. As the felt material leaves the stencil screen the pattern material is deposited on the felt surface. Depending on the type of pattern material used a period of time is required for the pattern material to harden. This can be accelerated via heat, catalysts or chemical additives depending on the type of printing material used.

An alternate pattern is shown in FIG. 4 in which side staggered slots are provided by side staggered raised dash members 24. In FIG. 4 the void area between dash's is designated by the numeral 14'.

A further alternate pattern is shown in FIG. 5 in which chevron members 26 separated by spacing 14" provide the pattern. The direction of felt travel is upwardly in FIG. 5. The chevrons 26 trap water and carry the water in the direction of felt travel to create a pumping action.

Thus it is seen that a press felt is provided in which lateral as well as longitudinal flow can be achieved as well as the creation of a pumping action.

I claim:

1. Press means for use in a papermaking machine including in combination a water permeable endless base fabric for transporting paper sheet, an upper surface thereof for receiving in contact therewith paper sheet to be transported, a backside thereof, press rolls for receipt of said fabric, a plurality of discrete raised relatively incompressible island members in firm engagement with said backside, said island members maintaining intersecting channels to allow for lateral and longitudinal flow of water expressed from paper sheet on said upper surface upon the entrance of said fabric into the nip of said press rolls.

2. A press fabric in accordance with claim 1 in which the island members are in the form of a stencilled pattern of dots.

3. A press fabric in accordance with claim 1 in which the island members are in the form of a stencilled pattern of ovalesque slots.

4. A press fabric in accordance with claim 1 in which the island members are in the form of a stencilled pattern of chevrons opening in the direction of felt travel.

* * * * *